US007569758B2

(12) United States Patent
Harada et al.

(10) Patent No.: US 7,569,758 B2
(45) Date of Patent: Aug. 4, 2009

(54) ELECTRONIC PERCUSSION SYSTEM AND ELECTRONIC PERCUSSION INSTRUMENT INCORPORATED THEREIN

(75) Inventors: Minoru Harada, Shizuoka (JP); Yuichirou Suenaga, Shizuoka (JP)

(73) Assignee: Yamaha Corporation, Shizuoka-ken (JP)

( * ) Notice: Subject to any disclaimer, the term of this patent is extended or adjusted under 35 U.S.C. 154(b) by 970 days.

(21) Appl. No.: 10/609,574

(22) Filed: Jul. 1, 2003

(65) Prior Publication Data

US 2004/0025663 A1 Feb. 12, 2004

(30) Foreign Application Priority Data

Aug. 7, 2002 (JP) ..... 2002-229638

(51) Int. Cl.
*G10D 13/02* (2006.01)

(52) U.S. Cl. ..... 84/411 M; 84/723; 84/730

(58) Field of Classification Search ..... 84/723–725, 84/730, 734, 104, 411 R–411 P, 412–421
See application file for complete search history.

(56) References Cited

U.S. PATENT DOCUMENTS 3,725,561 A * 4/1973 Paul ..... 84/726
4,154,137 A * 5/1979 Kobayashi ..... 84/411 R
4,226,156 A * 10/1980 Hyakutake ..... 84/730
4,244,266 A * 1/1981 Hardy ..... 84/411 M
4,519,288 A * 5/1985 Aluisi ..... 84/411 M
4,984,498 A * 1/1991 Fishman ..... 84/730
5,134,920 A * 8/1992 Clark ..... 84/730
5,345,037 A * 9/1994 Nordelius ..... 84/730
5,920,021 A * 7/1999 Good ..... 84/411 M
5,977,473 A * 11/1999 Adinolfi ..... 84/723
6,307,133 B1 * 10/2001 May et al. ..... 84/411 M
2002/0096035 A1 * 7/2002 Good ..... 84/414
2003/0133360 A1 * 7/2003 Love, III ..... 367/5
2006/0065099 A1 * 3/2006 Anderson ..... 84/411 M
2007/0022863 A1 * 2/2007 Ross ..... 84/411 M

FOREIGN PATENT DOCUMENTS

JP 49-039424 4/1974
JP 62-218995 9/1987
JP 63-62900 4/1988

* cited by examiner

*Primary Examiner*—David S. Warren
(74) *Attorney, Agent, or Firm*—DicksteinShapiroLLP

(57) ABSTRACT

An electronic drum system includes an electronic drum having a shell, a drum head stretched across an opening of the shell, a vibration sensor converting vibrations of the drum head to an electric signal and a damper held in contact with the reverse surface of the drum head; when a drummer strikes the drum head with a stick, the drum head is shaken, and vibrations follow; the damper is held in contact with a certain area on the reverse surface, and the shake and vibrations are propagated from another area free from the damper to the vibration sensor; the shake is surely propagated to the vibration sensor, and the vibrations are rapidly decayed; for this reason, the vibration sensor exactly discriminates the shake from the peaks of the vibrations, thereby preventing an electronic sound generator from unintentionally repeated electronic beats.

20 Claims, 6 Drawing Sheets

ELECTRONIC PERCUSSION SYSTEM AND ELECTRONIC PERCUSSION INSTRUMENT INCORPORATED THEREIN

FIELD OF THE INVENTION

This invention relates to an electronic percussion system and, more particularly, to an electronic percussion system responsive to beats for electronically producing drum sound and an electronic percussion instrument incorporated therein.

DESCRIPTION OF THE RELATED ART

While a drummer is beating drums, the drums produce loud sound, and the neighbor feels the loud drum sound noisy. Sometimes, the recording stuff has much trouble with the loud drum sound. Nevertheless, it is difficult to lessen the loud drum sound produced in the acoustic drums. Electronic drums have been developed. The electronic drum system is an electronic sound system responsive to the beats on the drum body. The drum body is never expected to vibrate for producing the drum sound, and serves as a switch for initiating the data processing. For this reason, the drum pad is adapted to rapidly damp the vibrations upon each strike.

A typical example of the electronic drum system is disclosed in Japan Patent Application laid-open No. 2001-142459. The prior art electronic drum system has a damper beneath the drum head. The damper is held in contact with the entire reverse surface of the drum head. When a drummer strikes the drum head, the drum head vibrates, and a vibration sensor converts the vibrations to an electric signal. However, the damper rapidly suppresses the vibrations. The electric signal is supplied from the vibration sensor to the electronic sound generator, and makes the electronic sound generator initiate the data processing for generating an audio signal, which is supplied to a sound system. Thus, the prior art electronic drum merely produces soft sound, and the loud electronic drum sound is radiated from the sound system. Of course, if the drummer instructs the electronic sound generator to decrease the volume, the electronic drum sound is faint, and never disturbs the neighborhood.

However, a problem is encountered in the prior art electronic drum system in that the electronic drum sound does not faithfully reflect the shots on the drum head.

SUMMARY OF THE INVENTION

It is therefore an important object of the present invention to provide an electronic percussion system, which produces the electronic percussion sound without any missing shot.

It is also an important object of the present invention to provide an electronic percussion instrument preferable in the electronic percussion system.

The present inventors investigated the cause of the missing shots, and found that the electronic sound generator sometimes failed to initiate the data processing for the audio signal. The present inventors further investigated the matter minutely. The present inventors noticed the electric signal representing some shots less discriminative from the other peaks of the vibrations. When the drummer struck the drum head with a stick, the drum head was strongly shaken due to the impact, and the wave was reflected on the inner periphery of the shell. The wave was repeatedly reflected so that the drum head continuously vibrated. However, the damper was held in contact with the entire reverse surface of the drum head. The vibrations were rapidly decayed. In other words, the damper prevented the neighborhood from the loud drum sound. The damper had unexpected influence on the deformation of the drum head immediately after some impacts such as weak impacts. The drummer could not strongly shake the drum head under the influence of the damper. The present inventors concluded that the damper was causative of missing some shots.

The present inventors focused their efforts on a damper effective against the loud drum sound but permitting the drummer to strongly shake the drum head. Various dampers were investigated. The present inventors concluded that the damper was to be spaced from the area beaten by drummers.

To accomplish the object, the present invention proposes to make a damper and a vibration sensor held in contact with different parts of a vibratory layer.

In accordance with one aspect of the present invention, there is provided an electronic percussion system for generating electronic sounds comprising an electronic percussion instrument including a frame, a vibratory layer supported by the frame and struck by a player for generating a shake followed by vibrations, a damper held in contact with a part of the vibratory layer for suppressing the vibrations of the vibratory layer and a vibration-to-electric signal converter held in contact with another part of the vibration layer free from the damper and producing an electric signal representative of the shake and the of vibrations, an electronic sound generator connected to the vibration-to-electric signal converter and producing an audio signal on the basis of the electric signal, and a sound sub-system connected to the electronic sound generator, and generating the electronic sounds from the audio signal.

In accordance with another aspect of the present invention, there is provided an electronic percussion instrument comprising a frame, a vibratory layer supported by the frame and struck by a player for generating a shake followed by vibrations, a damper held in contact with a part of the vibratory layer for suppressing the vibrations of the vibratory layer, and a vibration-to-electric signal converter held in contact with another part of the vibration layer free from the damper and producing an electric signal representative of the shake and the of vibrations.

BRIEF DESCRIPTION OF THE DRAWINGS

The features and advantages of the electronic percussion system and electronic percussion instrument will be more clearly understood from the following description taken in conjunction with the accompanying drawings, in which.

DESCRIPTION OF THE PREFERRED EMBODIMENTS

First Embodiment

System Configuration

Figure 1:
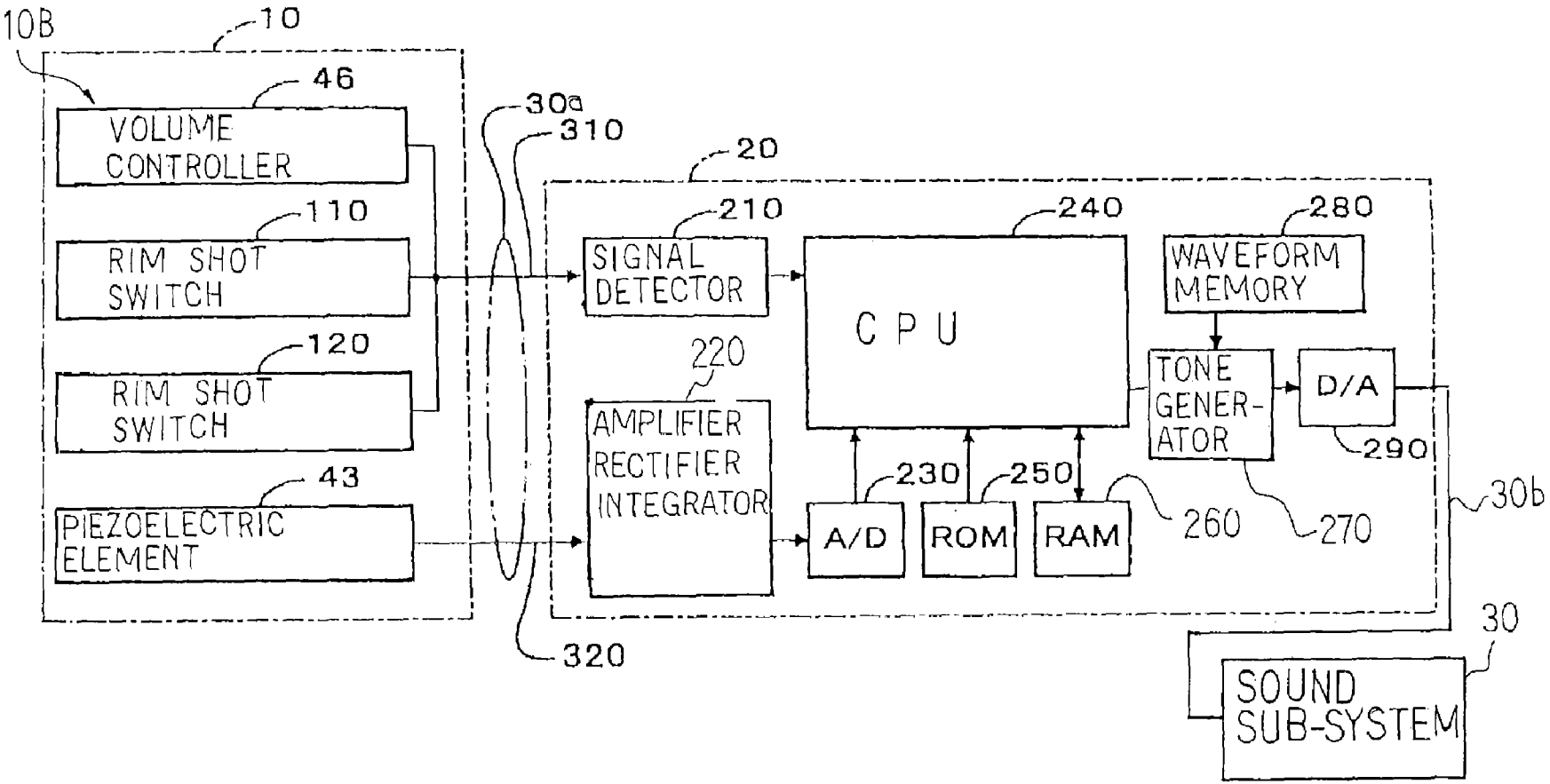
FIG. 1 is a block diagram showing the system configuration of an electronic drum system according to the present invention.

Referring to FIG. 1 of the drawings, an electronic drum system embodying the present invention largely comprises an electronic drum 10, an electronic sound generator 20, a sound sub-system 30, a stereo cable 30*a* and an audio cable 30*b*. The electronic drum 10 is connected through the stereo cable 30*a* to the electronic sound generator 20, which in turn is connected through the audio cable 30*b* to the sound sub-system 30.

The electronic drum 10 is beaten by a drummer with sticks. The electronic drum 10 vibrates, and converts the vibrations to electric signals representative of the beats. The beats are broken down into pad shots and rim shots. The pad shot and rim shot will be hereinlater described in detail. The electronic drum 10 is widely shaken at each pad shot, and accompanies the shake with vibrations. Each strong shake and its vibrations are observed as a "series of vibrations". Since the electronic drum 10 is widely shaken, the series of vibrations has a large peak value immediately after each pad shot. However, the amplification is rapidly decayed. The difference between the first peak value and the second peak value is so large that the shake is clearly discriminative from the vibrations.

One of the electric signals is called as a "pad shot signal" representative of the pad shot or shots, and the other is called as a "rim shot signal" representative of the rim shot or shots. The stereo cable 30*a* has a channel assigned to the pad shot signal and another channel assigned to the rim shot signal. When the drummer gives the pad shots and/or rim shots to the electronic drum, the pad shot signal and rim shot signal are independently propagated through the stereo cable to the electronic sound generator 20.

The electronic sound generator 20 is responsive to the pad shot signal and rim shot signal. When the pad shot signal and/or rim shot signal reaches the electronic sound generator 20, the electronic sound generator 20 initiates a data processing for producing an analog audio signal representative of beats on the electronic drum 10. As described hereinbefore, the individual shakes have the first peak values much greater than the second peak values so that the electronic sound generator 20 surely initiates the data processing at every pad shot. The electronic sound generator 20 starts to sequentially read out pieces of waveform data representative of the drum sound at the pad shot or at the rim shot, and joins the pieces of waveform data into the analog audio signal in the data processing.

The analog audio signal is propagated through the audio cable 30*b* to the sound sub-system 30. The analog audio signal is equalized, amplified and finally converted to the drum sound through the sound sub-system 30.

Figure 2:
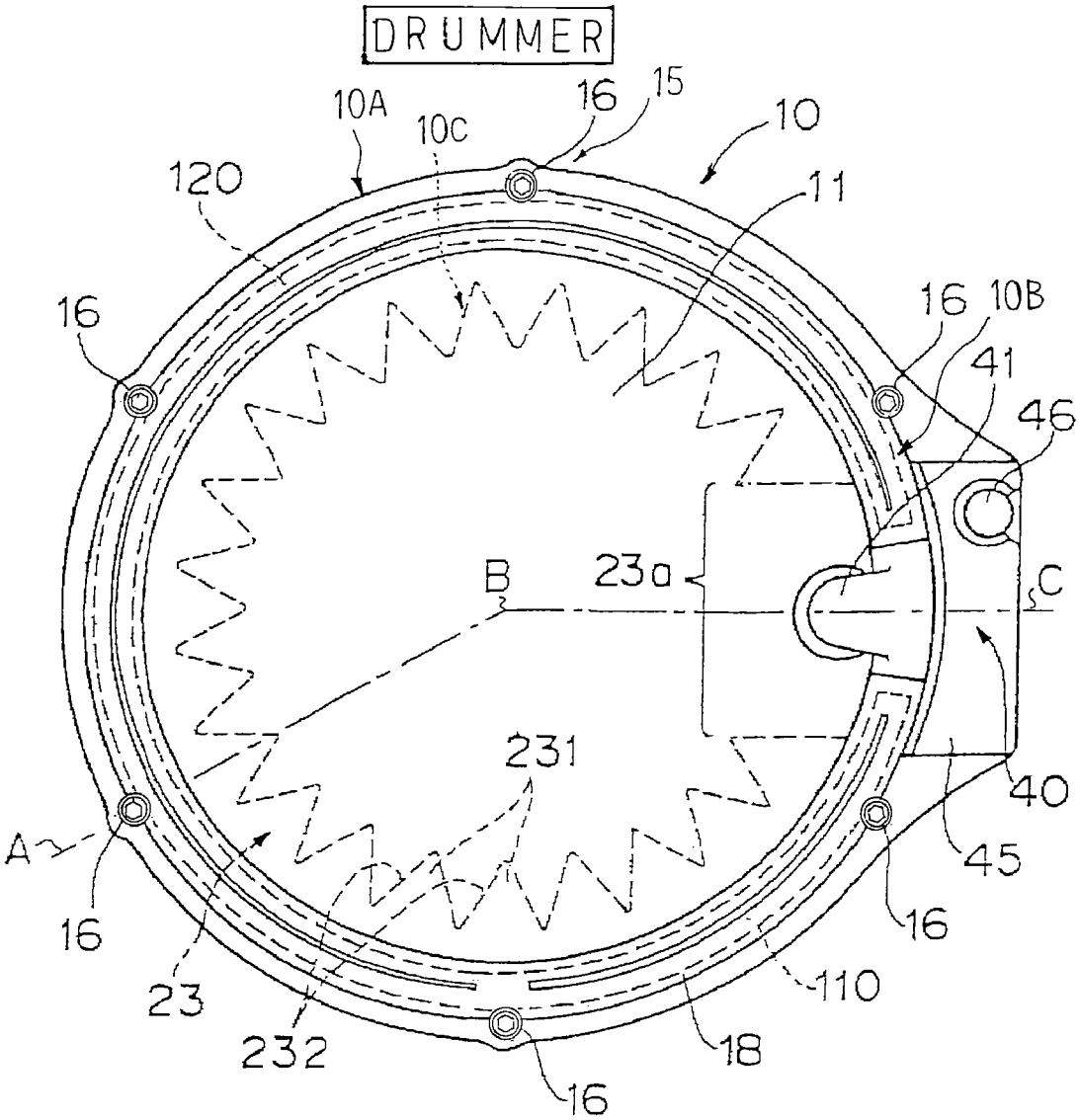
FIG. 2 is a plane view showing an electronic drum incorporated in the electronic drum system.

The electronic drum 10 and electronic sound generator 20 will be described in more detail with concurrent reference to FIGS. 1, 2 and 3. The electronic drum 10 is broken down into a drum body 10A, a vibration sensor 10B and a damper 10C. The drum body 10A is beaten with the sticks, and each beat gives rise to the series of vibrations. The vibration sensor 10B is attached to the drum body 10A, and converts the shake and vibrations to the pad shot signal and rim shot signal. The damper 10C is secured to the drum body 10A, and suppresses the vibrations. The damper 10C is held in contact with a part of the drum body 10A. However, the remaining part of the drum body 10A is free from the damper 10C. In other words, the damper 10C does not have any influence on the remaining part of the drum body 10A. The drummers usually beats the remaining part of the drum body 10A, but rarely beats the part of the drum body 10A where the damper 10C is held in contact. For this reason, when the drummer strikes the remaining part of the drum body 10A with the sticks, the remaining part of the drum body 10A is widely shaken, and the vibration sensor 10B produces a peak of the pad shot signal. Thus, the pad shot signal has the discriminative peaks by virtue of the remaining part of the drum body 10A, which is free from the damper 10C. The vibrations follow the shake of the drum head 11. The vibrations are spread over the drum body 10A, i.e., into the part of the drum body 10A. Then, the damper 10C suppresses the vibrations of the part of the drum body 10A. For this reason, the vibrations are rapidly damped.

In order to describe the pad shots and rim shots, the drum body 10A is roughly sketched. The drum body 10A includes a drum head 11, a hoop 12, a shell 13, a rim 14, a tension regulator 15 and a rim cushion 18. The shell 13 is cylindrical, and the drum head 11 is circular. The rim 14 has a ring shape, and the tension regulator 15 is secured to the shell 13. The circular drum head 11 is clamped with the hoop 12 along the periphery thereof, and the shell 13 is inserted into the hoop 12. Then, the circular opening of the shell 13 is covered with the drum head 11. The rim 14 is pressed to the hoop 12, and is coupled to the tension regulator 15. The tension regulator 15 strongly presses the rim 14 to the hoop 12, and the hoop 12 exerts the tension on the drum head 11. Thus, the drum head 11 is stretched over the opening of the shell 13, and the rim 14 extends along the periphery of the drum head 11. The rim 14 is covered with the rim cushion 18. The structure of the drum body 10A will be described hereinlater in more detail.

The pad shot is a beat on the drum head 11. The drummer once strikes the drum head 11 with a stick for the single pad shot. On the other hand, the rim shot is a beat on the rim/rim cushion 14/18. There are two sorts of rim shots. The first rim shot is called as "open rim shot", and the drummer concurrently strikes a certain part of the rim/rim cushion 14/18 and the drum head 11 with a stick for the open rim shot. The certain part of the rim cushion 18 is usually close to the drummer, and the drum head 11 is struck with the tip of the stick. The other sort of rim shot is called as "close rim shot". When the drummer gives the close rim shot, the drummer beats another part of the rim/rim cushion 14/18 father from him or her than the certain part, and brings his or her fingers into contact with the drum head 11. In case where the electronic drum 10 is small, the drummer may press the grip of the stick to the certain part and strike another part with the tip of the stick. The open rim shot and close rim shot give different colors to the drum sound.

The vibration sensor 10B includes a piezoelectric element 43, a volume controller 46 and two rim shot switches 110/120, and the electronic tone generator 20 includes a signal detector 210, a combined circuit 220 of amplifier, rectifier and integrator, an analog-to-digital converter 230, a central processing unit 240, a read only memory 250, a random access memory 260, a tone generator 270, a waveform memory 280 and a digital-to-analog converter 290 as shown in FIG. 1. Two output signal lines or the two channels of the stereo cable 30*a* are labeled with reference numerals 310 and 320, respectively. However, the shield line is not omitted for the sake of simplicity.

The rim shot switch 120 is associated with the certain part of the rim/rim cushion 14/18, and is expected to detect the open rim shot. The other rim shot switch 110 is associated with the other part of the rim/rim cushion 14/18, and turns on at the close rim shot. The volume controller 46 relates to the bottom level of the rim shot signal. When the drummer manipulates the volume controller 46, the volume controller 46 shifts the bottom level of the rim shot signal from the current potential level to another potential level, and the electronic sound generator 20 changes the timbre of the drum sound to be produced at the beats on the drum head 11. The rim shot switches 110/120 raise the rim shot signal from the bottom level to different potential levels. When the drummer strikes the rim/rim cushion 14/18 over the rim shot switch 110, the rim shot switch 110 turns on, and raises the rim shot signal from the bottom level to a certain potential level. On the other hand, when the drummer strikes the rim/rim cushion 14/18 over the other rim shot switch 120, the rim shot switch 120 turns on, and raises the rim shot signal from the bottom level to another potential level. In case where the drummer causes both rim shot switches 110/120 concurrently turn on, the rim shot signal rises from the bottom level to yet another potential level. Thus, the rim shot signal is representative of the piece of data information representative of the timbre of the drum sound and the pieces of data information representative of the current status of the rim shot switches 110/120.

The volume controller 46 and rim shot switches 110/120 are connected through the output signal line 310 to the signal detector 210, and the signal detector 210 is connected to a data port of the central processing unit 240. The signal detector 210 converts the analog rim shot signal to a digital rim shot signal, and the digital rim shot signal, which represents a series of discrete values representative of the potential level of the rim shot signal, is supplied to the central processing unit 240. The central processing unit 240 analyzes the digital rim shot signal, and determines the timbre to be imparted to the drum sound and the current status of the rim shot switches 110/120.

The piezoelectric element 43 converts the series of vibrations to the analog pad shot signal representative of the waveform of the vibrations. The piezoelectric element 43 supplies the pad shot signal through the other output signal line 320 to the combined circuit 220 of amplifier, rectifier and integrator. The combined circuit 220 extracts the peaks from the analog pad shot signal, and produces an analog envelope signal representative of the envelope of the analog pad shot signal. The combined circuit 220 is connected to the analog-to-digital converter 230, and supplies the analog envelope signal to the analog-to-digital converter 230. The analog-to-digital converter 230 converts the analog envelope signal to discrete values, and produces a digital envelope signal representative of the discrete values. The analog-to-digital converter 230 is connected to another data port of the central processing unit 240, and the central processing unit 240 fetches the series of discrete values from the digital envelop signal.

The central processing unit 240 is connected to the read only memory 250 and random access memory 260. In this instance, a computer program is stored in the read only memory 250, and the random access memory 260 offers a temporary data storage or a working memory area to the central processing unit 240.

The central processing unit 240 achieves the following tasks through the computer program. First, the central processing unit 240 periodically fetches the discrete value of the digital rim shot signal and the discrete value of the digital envelope signal, and stores the discrete values in the random access memory 260. The second task is to determine the current bottom level of the rim shot signal. The third task to be achieved by the central processing unit 240 is to analyze the discrete values of the digital rim shot signal and the discrete values of the digital envelope signal for determining the sticking on the electronic drum 10. The fourth task is to produce digital music codes representative of events, velocity and timbre.

The computer program is broken down into a main routine program and sub-routine programs. The first and second tasks are achieved through the main routine program. When the electronic drum system is powered, the central processing unit 240 starts to run on the main routine program. The central processing unit 240 repeatedly executes the main routine program for the first and second tasks and other additional tasks, and terminates the execution upon reception of user's instruction for it. A timer is incorporated in the electronic sound generator 20, and periodically gives rise to a timer interruption. The timer may be a software timer. When the timer interruption takes place, the main routine program branches to the sub-routine program, and the central processing unit 240 achieves the third and fourth tasks.

The electronic drum system is assumed to be powered. The central processing unit 240 firstly initializes the associated system components such as the working memory area, and defines tables in the working memory area. One of the tables is assigned to the rim shot switches 110/120, and the discrete values of the rim shot signal are sequentially written therein. Another table is assigned to the piezoelectric element 43, and the discrete values of the pad shot signal are sequentially written therein. Yet another table, which is hereinafter referred to as "control table", is assigned to the tone generator 270, and indicates current status of sound generating channels of the tone generator 270 together with the lapse of time from the on-event.

Upon completion of the initialization, the central processing unit 240 waits for a request for data fetch. The signal detector 210 and analog-to-digital converter 230 periodically request the central processing unit 240 to fetch the digital rim shot signal and digital pad shot signal. Upon reception of the request for the data fetch, the central processing unit 240 transfers a digital code representative of the discrete value of the digital rim shot signal and a digital code representative of the discrete value of the digital pad shot signal from the data ports to the random access memory 260, and accumulates the digital codes in the tables. Thus, the central processing unit 240 achieves the first task in the main routine program.

Subsequently, the central processing unit 240 checks the table assigned to the digital rim shot signal to see whether or not a predetermined number of latest digital codes are indicative of the bottom level of the rim shot signal. If the answer is given negative, the central processing unit 240 waits for the request for the data fetch, and repeats the first task. On the other hand, when the answer is given affirmative, the central processing unit 240 determines the current bottom level of the rim pad signal, and compares the current bottom level with reference levels indicative of the timbres of the drum sound to see whether or not the drummer instructs the electronic sound generator to change the drum sound from the current timbre to another timbre. If the answer is given affirmative, the central processing unit 240 determines a new timbre, and writes a piece of music data information representative of the new timbre into a working register in the working memory area. On the other hand, when the answer is given negative, the central processing unit 240 keeps the piece of music data information, which have been already stored in the working register, in the working register. When the central processing unit 240 determines the bottom level, the central processing unit 240 calculates the threshold levels for the combinations of the rim shot signals 110/120. Thus, the central processing unit 240 achieves the second task in the main routine program.

The timer is assumed to give rise to the timer interruption. The main routine program branches to the sub-routine program. Upon entry into the subroutine program, the central processing unit 240 accesses the table assigned to the digital rim shot signal and the table assigned to the digital pad shot signal. When the central processing unit 240 accesses the table assigned to the digital rim shot signal, the central processing unit 240 analyzes the discrete values for a peak representative of the rim shot. On the other hand, when the central processing unit 240 accesses the table assigned to the digital pad shot signal, the central processing unit 240 analyzes the discrete values for a peak representative of the pad shot. If the predetermined number of discrete values represent continuous increase, continuous decrease or the bottom level, the central processing unit 240 returns to the main routine program.

The central processing unit 240 is assumed to find the peak in the series of discrete values represented by the rim shot signal, the central processing unit 240 compares the peak value with the thresholds, and determines the sort of rim shot, i.e., the open rim shot or close rim shot. The central processing unit 240 calculates a velocity or the intensity of the impact at the beat on the basis of the series of discrete values. Similarly, when the central processing unit 240 finds the peak in the series of discrete value represented by the pad shot signal, the central processing unit 240 calculates a velocity or the intensity of the impact at the beat. The velocity is representative of the loudness of the drum sound, and the sort of sticking and velocity are stored in other working registers. Thus, the central processing unit 240 achieves the third task through the sub-routine program.

When the central processing unit 240 finds the peak in the series of discrete values of the rim shot signal or pad shot signal, the central processing unit 240 starts to produce a set of music data codes. The set of music data codes are representative of the timbre of the electronic beat to be generated, velocity or loudness of the electronic beat and an on-event. The on-event means that the tone generator 270 has to start the generation of the electronic beat. On the other hand, an off-even means that the tone generator 270 has to decay the electronic beat. The central processing unit 240 supplies the set of music data codes to the tone generator 270, and the tone generator 270 starts to generate the electronic beat as described hereinafter in detail.

The central processing unit 240 registers the on-event in the control table, and starts to measure the lapse of time after the generation of the drum sound. In this instance, the central processing unit 240 sets an associated software timer of the control table to a predetermined time period, and decrement the predetermined time period upon entry into every sub-routine program. When the timer reaches zero, the central processing unit 240 produces the music data code representative of the off-event, and supplies the music data code to the tone generator 270. Then, the tone generator 270 decays the drum sound. Thus, the central processing unit 240 achieves the third and fourth tasks through the sub-routine program.

The waveform memory 280 has plural memory areas assigned to sets of waveform data codes, and the sets of waveform data codes respectively represent the envelopes of acoustic beats different in timbre from one another. The tone generator 270 has plural sound generation channels, and is connected to the waveform memory 280. The tone generator 270 selectively assigns the sound generation channels to the on-events, and sequentially reads out the sets of waveform data codes from the waveform memory 280. The tone generator 270 modifies the series of waveform data codes depending upon the velocity, and, thereafter, supplies the waveform data codes to the digital-to-analog converter 290.

The set of music data codes, which contains pieces of music data information representative of the on-event, a certain timbre presently assigned to the drum head 11 and a certain loudness, is assumed to reach the tone generator 270. The tone generator 270 selects a memory area where a set of waveform data codes is stored for the certain timbre from the waveform memory 280, and starts to successively read out the waveform data codes. The tone generator 270 modifies the read-out waveform data codes with the parameter for adjusting the electronic beat to the certain loudness. The tone generator may further modify the waveform data codes with other parameters for imparting certain effects. While the tone generator 270 is reading out the set of waveform data codes from the waveform memory 280, another set of music data codes may reach the tone generator 270. Then, the tone generator 270 starts to read out a set of waveform data codes from the waveform memory 280 through another sound generating channel. Thus, the tone generator 270 can read out the set of or sets of waveform data codes through the plural sound generating channels for concurrently generating the electronic beats.

The tone generator 270 supplies the waveform data codes modified with the parameters to the digital-to-analog converter 290. The digital-to-analog converter 290 produces the analog audio signal representative of the electronic beat or beats from the waveform data codes, and supplies the analog audio signal to the sound sub-system 30. The analog audio signal is equalized and amplified through the equalizer/amplifier of the sound sub-system 30, and, thereafter, converted to the electronic beats through the loud speakers.

The music data code representative of the off-event is assumed to reach the tone generator 270. Then, the tone generator 270 makes the sound subsystem 30 decay the electronic beat.

Structure of Electronic Drum

Turning back to FIGS. 2 and 3, the electronic drum 10 is described in more detail. The drum head 11, hoop 12, shell 13, rim 14, tension regulator 15 and rim cushion 18 form in combination the drum body 10A. In this instance, the drum body 10A has the external appearance like a snare drum. The drum head 11 is of a mesh type made from plural sheets of net. Sheets of net are a sort of plain weave fabric, and the woofs cross the wefts at right angles. The sheets of net are arranged in such a manner that the textures obliquely extend each other. The drum head 11 has a circular periphery, and the circular periphery is clamped with the hoop 12.

The shell 13 is made of reinforced synthetic resin, and is cylindrical. The shell 13 may be made of wood. Otherwise, the shell may be made of metal or alloy such as, for example, aluminum or aluminum alloy. The aluminum shell may be shaped through a die-casting. The shell 13 is held in such a manner that the centerline thereof is vertical. For this reason, the shell 13 has an upper opening and a lower opening. The drum head 11 is spread over the upper opening of the shell 13, and the hoop 12 extends around the upper portion of the shell 13.

The rim 14 is, by way of example, made of metal or alloy, and has a stepped ring configuration. The innermost diameter of the rim 14 is smaller than the outer diameter of the shell 13, and the next diameter is slightly larger than the inner diameter of the hoop 12. However, the outermost portion of the rim 14 has the inner diameter much larger than the outer diameter of the hoop 12, and is formed with six through-holes 14*a* at intervals on a virtual circle. The rim 14 is covered with the rim cushion 18, and is put on the hoop 12. The rim cushion 18 is made of rubber.

The tension regulator 15 is implemented by six lugs 15*a* and associated tuning bolts 16. The six lugs 15*a* are arranged on the side surface of the shell 13 at intervals equal to the intervals of the through-holes 14*a*, and are secured to the shell 13 by means of bolts 15*b* as will be better seen in FIG. 4. The lugs 15*a* are formed with female screws 15*c* on a virtual circle, which is equal in diameter to the virtual circle for the through-holes 14*a*. The rim 14 is positioned around the shell 13 in such a manner that the through-holes 14*a* are aligned with the female screws 15*c*. The associated tuning bolts 16 are driven into the lugs 15*a* through the through-holes 14*a*. Then, the rim 14 is pressed to the hoop 12, and exerts tension on the drum head 11.

Figure 3:
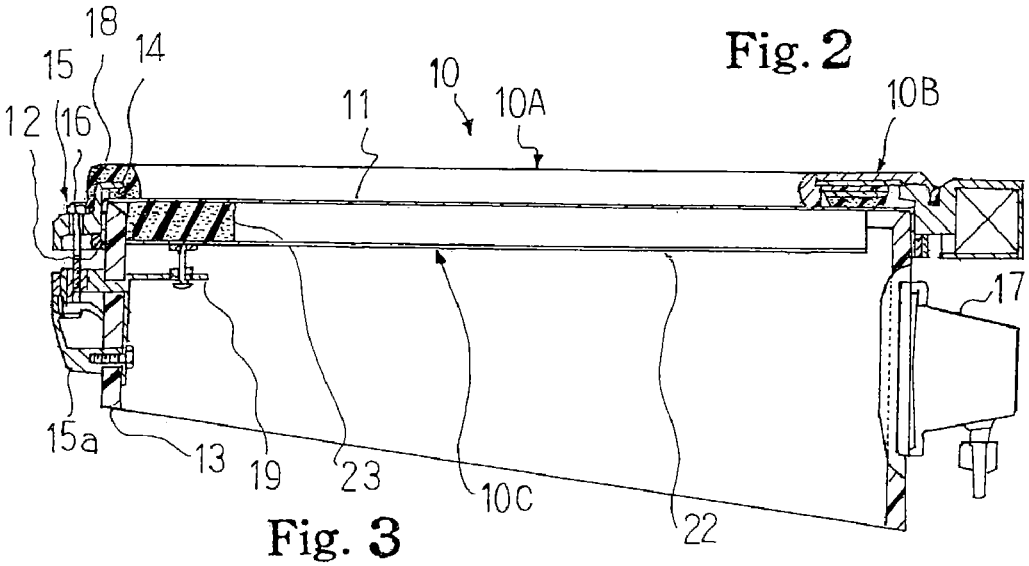
FIG. 3 is a cross sectional view taken along line A-B-C of FIG. 2, and showing the structure of an electronic drum.

As shown in FIG. 3, a clamp 17 is further secured to the shell 3 so that the electronic drum 10 is coupled to a frame (not shown) by means of the clamp 17.

Figure 4:
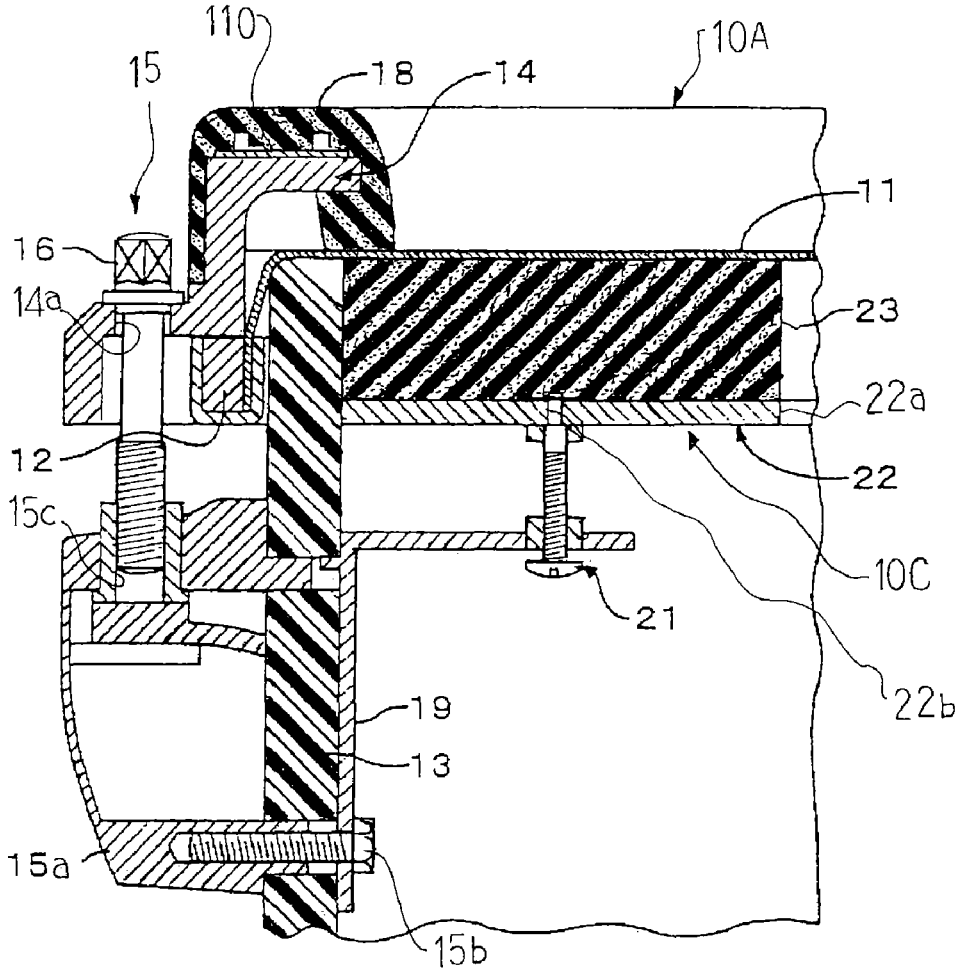
FIG. 4 is a cross sectional view showing a tension regulator and a damper incorporated in the electronic drum.

The vibration sensor 10B includes the rim shot switches 110/120, piezoelectric element 43 and volume control 46. The rim shot switches 110/120 are formed by film switches or membrane switches, and have a configuration like halves of a ring. The rim shot switches 110/120 are put on the upper surface of the rim 14 as shown in FIG. 4. The upper surface of the rim 14 is imaginarily sprit into two halves. The rim shot switch 110 occupies one of the halves of the upper surface, and is closer to the drummer than the other rim shot switch 120 on the other half of the upper surface. The rim shot switches 110/120 are covered with the rim cushion 18. When the drummer strikes the rim cushion 18 with a stick, the impact is exerted on the rim shot switch 110 or 120 under the struck point through the rim cushion 18, and the rim shot switch 110 or 120 turns on.

Figure 5:
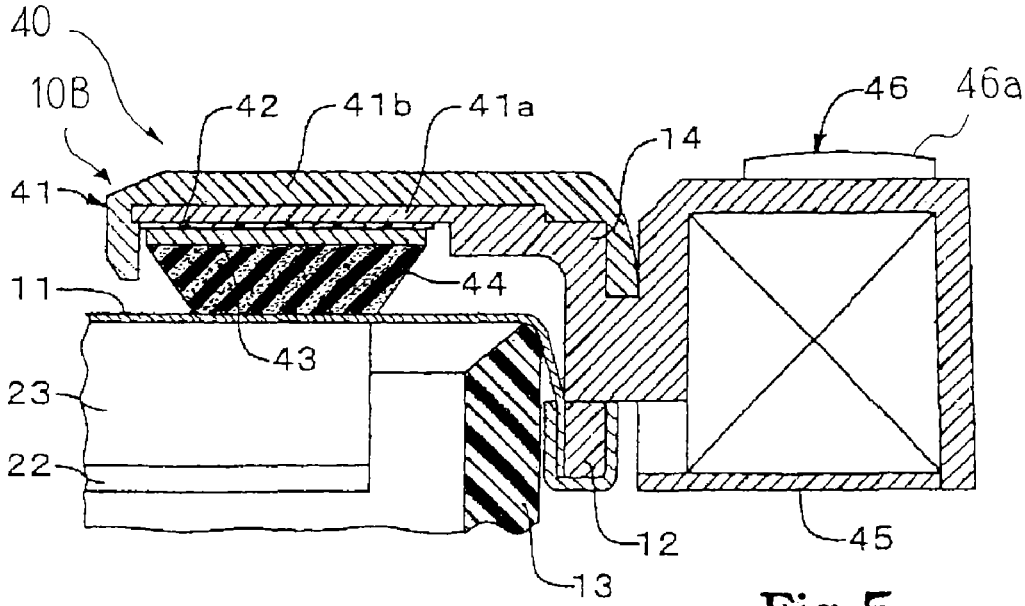
FIG. 5 is a cross sectional view showing a vibration sensor incorporated in the electronic drum.

A sensor unit 40 is provided over the clamp 17, and the piezoelectric element 43 and volume controller 46 are incorporated in the sensor unit 40. As will be better seen in FIG. 5, a sensor holder 41 inwardly projects from the rim 14, and a case 45 outwardly projects from the rim 14. The volume control 46 is housed in the case 45, and a dial 46*a* is exposed on the upper surface of the case 45 to a drummer. The drummer rotates the dial 46*a* with fingers for changing the timbre of the electronic beats assigned to the drum head 11.

The sensor holder 41 has a base plate 41*a* and a cover plate 41*b*. The rim 14 is integral with the base plate 41*a*, and the base plate 41*a* is covered with the cover plate 41*b*. The piezoelectric element 43 is bonded to the lower surface of the base plate 41*a* by means of adhesive compound 42, and a sensor cushion 44 is adhered to the lower surface of the piezoelectric element 43. The piezoelectric element 43 serves as a vibration-to-electric current converter, and the sensor cushion 44 is made of rubber or urethane sponge. The sensor cushion 44 reaches the drum head 11, and the shake and vibrations of the drum head 11 are propagated through the sensor cushion 44 to the piezoelectric element 43. For this reason, the piezoelectric element 43 coverts the series of vibrations to the electric signal.

The damper 10*c* includes six brackets 19, bolts 21, a supporting plate 22 and a damping block 23. The brackets 19 and bolts as a whole constitute an adjuster. The brackets 19 have an inverted L-letter cross section, and are secured to the inner surface of the shell 13 by means of the blots 15*b*. The brackets 19 are formed with female screws, and the female screws have centerlines substantially parallel to the centerline of the shell 13. The bolts 21 are respectively engaged with the female screws, and upwardly project from the associated brackets 19. The supporting plate 22 is made of metal such as, for example, iron, and has a C-letter configuration. The supporting plate 22 has a zigzag inner periphery 22*a*, and the zigzag inner periphery 22*a* defines triangle inlets. Holes 22*b* are formed in the supporting plate 22 at intervals, and tips of the bolts 21 project into the holes 22*b*, respectively. For this reason, the bolts 21 are brought into contact with the lower surface of the supporting plate 22 at the steps between the tips and the threaded stems. The bolts 21 keep the supporting plate 22 over the brackets 19. A drummer is assumed to further screw the bolts 21 into the brackets 19. The bolts 21 are pressed to the supporting plate 22, and the supporting plate 22 is moved upwardly. On the other hand, when the drummer loosens the bolts 21, the self-weight makes the supporting plate 22 get close to the brackets 19.

The damping block 23 is adhered to the upper surface of the supporting plate 22, and is, by way of example, made of urethane sponge. The damping block 23 is moved together with the supporting plate 22. If the drummer lifts the supporting plate 22, the damping block 23 is lifted, and is pressed to the drum head 11. On the other hand, if the drummer downwardly moves the supporting plate 22, the damping block 23 removes the pressure from the drum head 11. Thus, the drummer can regulate the pressure between the damping block 23 and the drum head 11 by using the bolts 21. This feature is preferable to drummers, because the damping block 23 appropriately pressed to the drum head 11 makes the vibrations rapidly decayed. In other words, the first peak is clearly discriminative from the other peaks. The electronic sound generator 20 does not produce the electronic beat twice at a single pad shot.

Turning back to FIG. 2, the damping block 23 has a C-letter configuration, and both ends are spaced from each other. In other words, a gap 23*a* takes place between both ends of the damping block 23. The damping block 23 extends along the periphery of the drum head 11, and permits the sensor holder 41 inwardly to project from the rim 14 into the gap 23*a*. The sensor cushion 44 is held in contact with the drum head 11 over the gap 23*a*, and is free from the influence of the damping block 23. This feature is preferable, because the shake immediately after the impact reaches the piezoelectric element 42 without the influence of the damping block 23. This results in a discriminative peak of the electric signal.

The damping block 23 has a zigzag inner surface. In other words, small triangles 231 range along the inner periphery of the shell 13, and an inlet 232 takes place between every two adjacent small triangles 231. The inlets 232 are located over the inlets of the supporting plate 22, and the zigzag inner periphery 22*a* are aligned with the zigzag inner surface of the damping block 23. The bottoms of the inlets 232 are closer to the inner surface of the shell 13 than the vertexes of the small triangles 231, and, accordingly, the vertexes of the small triangles 231 are closer to the center B than the bottoms of the inlets 232. Thus, the distance between the center B and the tips of the small triangles 231 is shorter than the distance between the bottoms of the inlets 232 and the center B.

As described hereinbefore, the damping block 23 has the top surface held in contact with the reverse surface of the drum head 11, and makes the drum head 11 broken down into three areas, i.e., a peripheral area held in contact with the damping block 23, a central area free from the damping block 23 and a transition area partially held in contact with the damping block 23 and partially free from the damping block 23. The small triangles 231 and inlets 232 are under the transition area.

A drummer is assumed to be in his or her performance on the electronic drum system. When the drummer gives the open rim shot and close rim shot to the rim cushion 18, the impacts are exerted on the rim shot switches 110 and 120, and the rim shot switches 110/120 selectively turn on. The electric signals are supplied from the rim shot switches 110/120 to the electronic sound generator 20, and the electronic sound generator 20 generates the analog audio signal through the data processing described hereinbefore. The analog audio signal is supplied from the electronic sound generator 20 to the sound system 30, and is converted to the electronic beats corresponding to the acoustic beats at the open rim shot and close rim shot.

Subsequently, the drummer strikes the drum head 11 with the stick, and gives rise to the strong shake in the drum head 11. The vibrations follow the shake of the drum head 11. The strong shake is recognized as a high peak discriminative from the peaks of the vibrations, and the electronic sound generator 20 produces the analog audio signal exactly representing the strike with the stick. The electronic sound generator 20 and sound system 30 neither twice produce the electronic beat nor miss any beat on the drum head.

Figure 6:
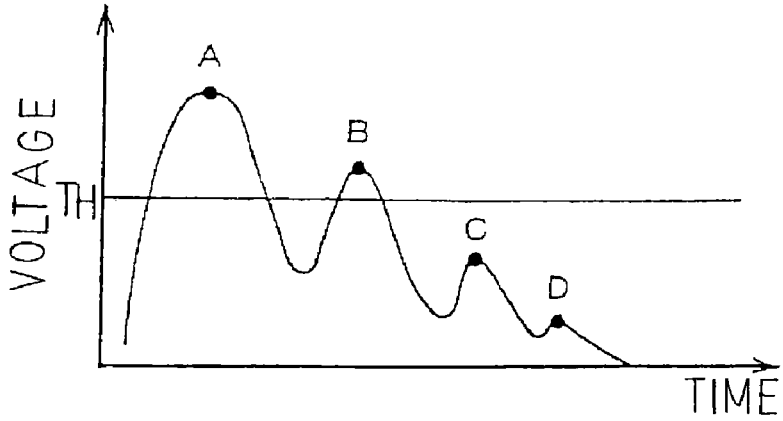
Fig. 6 PRIOR ART
FIG. 6 is a graph showing the waveform of a series of vibrations of a drum head incorporated in an electronic drum without any damper.
Figure 7:
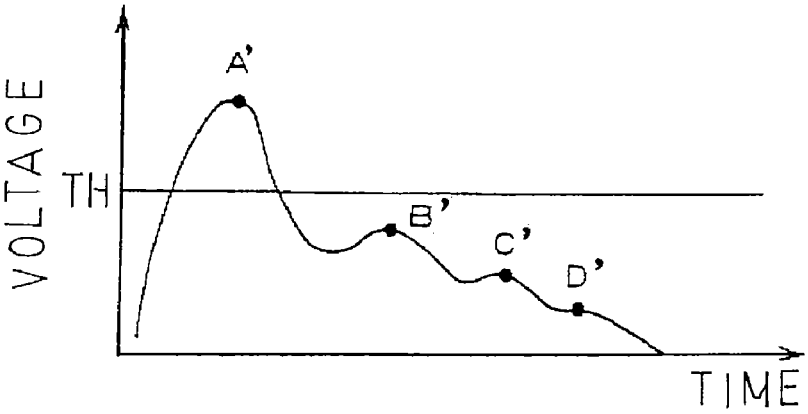
FIG. 7 is a graph showing the waveform of a series of vibrations of a drum head incorporated in the electronic drum.

FIG. 6 shows the waveform of an electric signal representative of a series of vibrations of a drum head of an electronic drum, which was not equipped with any damper, and FIG. 7 shows the waveform of the electric signal representative of a series of vibrations of the drum head 11 of the electronic drum 10 implementing the first embodiment. The first peak A was indicative of the shake at the strike against a certain point on the drum head, and the other peaks B, C and D were representative of the vibrations after the shake. The electric signal was gradually decayed, and the peaks A, B, C and D were stepwise decreased. Similarly, the first peak A' was indicative of the shake of the drum head 11 at the strike against the corresponding area on the drum head 11, and the other peaks B', C' and D' were representative of the vibrations. Comparing the first peak A' with the first peak A, although the first peak A was as high as the first peak A', the second peak B' was much smaller than the second peak B. In fact, the drum head 11 was strongly shaken so that any missing shot did not take place. Moreover, the damper 10C rapidly suppressed the vibrations of the drum head 11, and the electronic drum 10 notified the listener of faint sound. Thus, the damper 10C was effective against the missing shot and noisy beat sound.

The second peak B had the peak value greater than 70% of the peak value of the first peak A. On the other hand, the second peak B merely had the peak value less than 50% of the peak value of the first peak A'. Thus, the damping block 23 caused the drum head 11 drastically to decay the second peak B'. In case where the designer had set a threshold TH for the generation of the electronic beat, the electronic drum system, in which the electronic drum without any damper had been incorporated, generated the electronic beat twice, because the second peak B exceeded the threshold TH as well as the first peak A. On the other hand, the electronic drum system, in which the electronic drum 10 had been incorporated, exactly discriminated the first peak A' from the other peaks B', C' and D', and generated the electronic beat once. When the drum head 11 was struck with the stick immediately after the first strike, the electronic sound generator 20 exactly discriminated the first peaks A' of the two strikes, and the electronic beat was generated twice. However, the vibrations of the first strike did not influence the second peak B' of the second strike. Even though the drum head 11 was vibrating at the second strike, only the first strike A' exceeded the threshold TH. In other words, although the second peak B' of the second strike was overlapped with the remaining vibrations of the first strike, any beat was not generated from the loud speakers.

Thus, the damper 10C was effective against the unintentional electronic beat.

Figure 8:
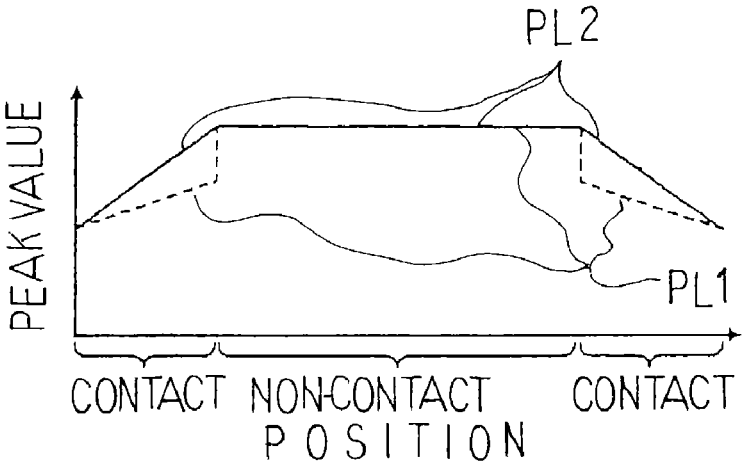
FIG. 8 is a graph showing the peak values observed after strikes at certain points on a diameter of the drum head.

The zigzag inner surface of the damping block 23 was effective against abrupt discontinuity of the loudness. The present inventors prepared a ring-shaped damping block, which had a smoothly curved inner surface, i.e., any inlet was not formed in the ring-shaped damping block. The present inventors struck the drum head of the comparative electronic drum and the drum head 11 of the electronic drum 10 with the stick along the diameter thereof, and plotted the peak values of the first peak A' in FIG. 8.

Plots PL1 stood for the peak values on the drum head of the comparative electronic drum, and plots PL2 were representative of the peak values on the drum head 11 of the electronic drum 10. An abrupt discontinuity took place at the boundary between the peripheral area held in contact with the ring-shaped damping block and the central area free from the ring-shaped damping block on the drum head of the comparative electronic drum as indicated by plots PL1. Accordingly, the loudness of the electronic beats was drastically reduced at the abrupt discontinuity. On the other hand, the peak values were gradually decreased from a virtual circle, which was drawn in such a manner as to pass the innermost vertexes of the small triangles 231, toward the inner periphery of the shell 13, and the loudness of the electronic beats was gradually reduced across the virtual circle.

The difference is derived from the influence of the damping blocks on the vibrations of the drum heads. When the drum head is struck with the stick, the impact makes the drum head resiliently deformed, and gives rise to the wave. If the impact point is in the area free from the damping block, all the impact energy is converted to the resilient deformation of the drum head, and a large wave takes place. The piezoelectric element converts the large wave to the electric signal with a high peak. On the other hand, if the impact point is in the area held in contact with the damping block, the impact energy is partially converted to the resilient deformation of the drum head and partially consumed by the damping block. This means that only a small wave takes place, and the electric signal exhibits a low peak.

In the comparative electronic drum, the boundary between the area held in contact with the damping block and the area free from the damping block is clear, and there is not any transition area between the two areas. When the drummer moves the stick across the boundary, the drum head is immediately put under the influence of the damping block, or is immediately released from the influence of the damping block. For this reason, the abrupt discontinuity takes place as indicated by plots PL1.

On the other hand, the transition area is provided between the central area free from the damping block 23 and the peripheral area held in contact with the damping block in the drum head 11 of the electronic drum 10. The drum head 11 is liable to be more deformable in the transition area rather than in the peripheral area, because only the small triangles 231 are held in contact with the transition area. Moreover, the contact area is increased from the boundary between the central area and the transition area to the boundary between the transition area and the peripheral area. For this reason, the peak value is gradually reduced from the boundary between the central area and the transition area to the boundary between the transition area and the peripehral area. The transition area is preferable to drummers, because the loudness of electronic beats is never drastically varied.

The sensor cushion 44 is held in contact with an extension of the central area. In other words, the damping block 23 is not held in contact with the area with which the sensor cushion 44 is held. For this reason, the series of vibrations reaches the sensor cushion 44 without any influence of the damping block 23. The vibrating drum head 11 strongly shakes the sensor cushion 44, and clearly produces the first peak A' in the electric signal.

As will be understood from the foregoing description, the electronic drum 10 has the damping block 23 held in contact the peripheral area of the drum head 11. The damping block 23 permits the drummer to strongly shake the drum head 11 with the sticks, and suppresses the vibrations, which follow the shake. This results in that the electronic sound generator 20 and sound subsystem 30 faithfully produce the electronic beats without any missing shot and loud drum sound.

Moreover, the damping block 23 has the zigzag inner surface, which defines the small triangles 231 and inlets 232 so that the drum head 11 has the transition area between the central area and the peripheral area. The transition area is preferable to drummers, because the drummer can beat the drum head 11 without any payment of attention to the damping block 23.

Second Embodiment

Figure 9:
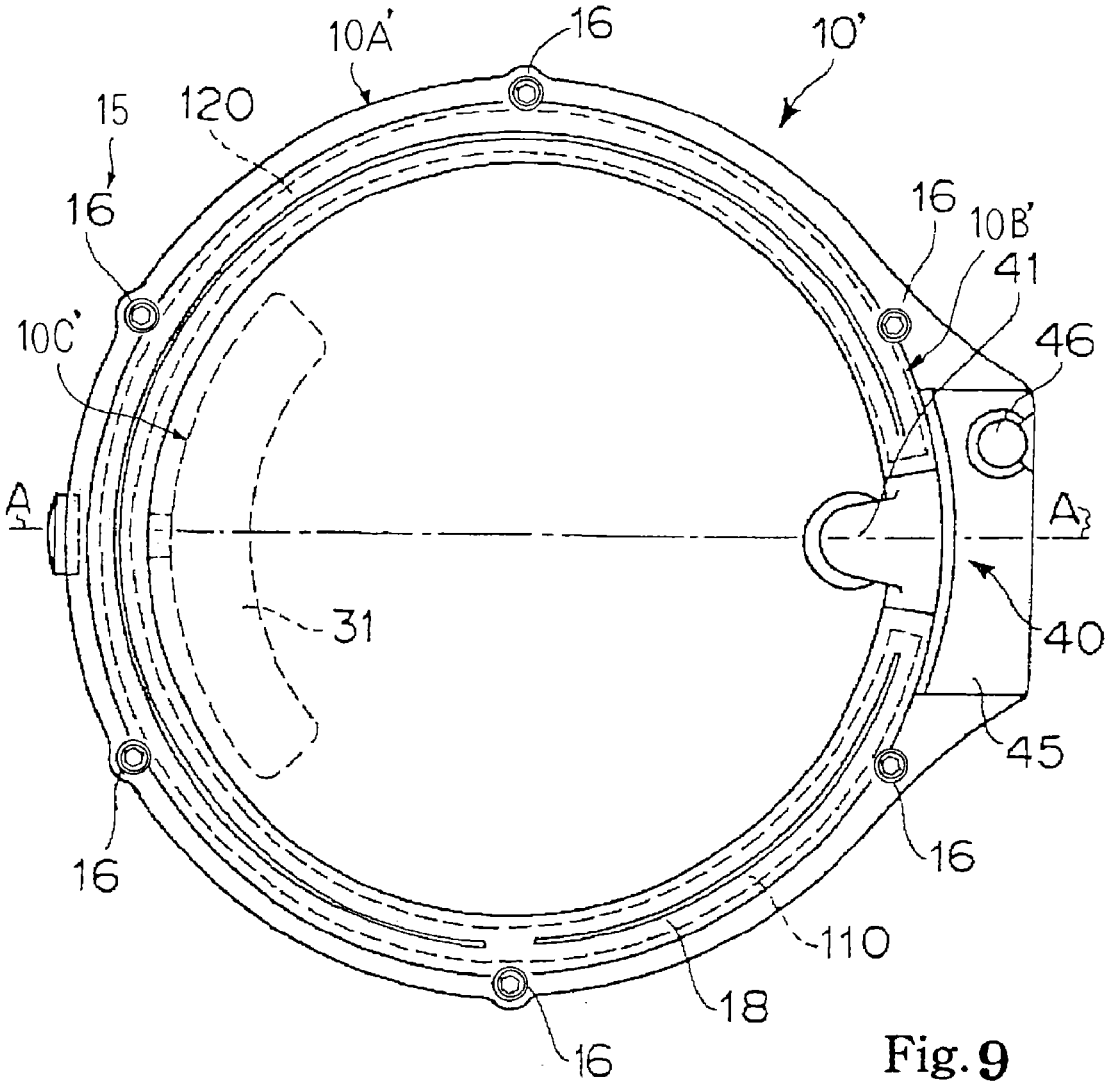
FIG. 9 is a plane view showing an electronic drum incorporated in another electronic drum system according to the present invention.
Figure 10:
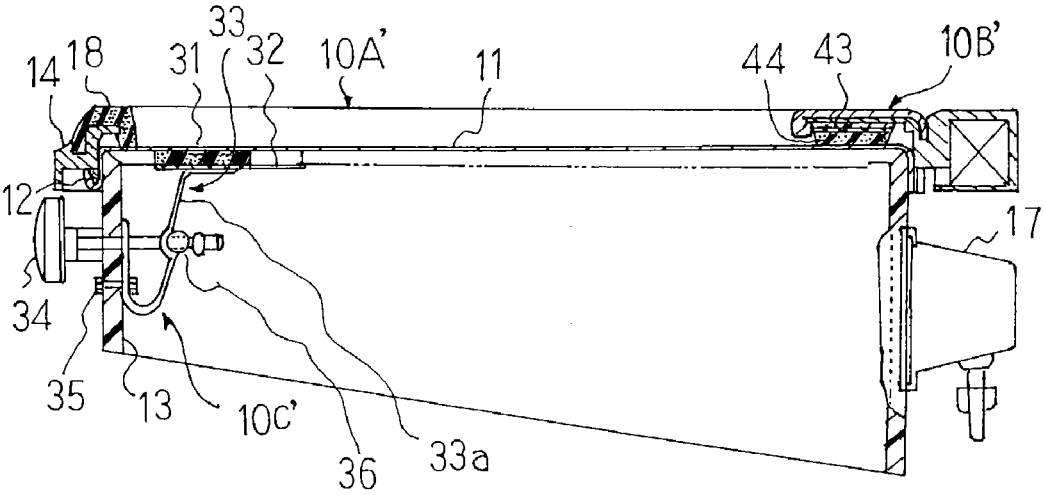
FIG. 10 is a cross sectional view taken along line A-A of FIG. 9 and showing the structure of the electronic drum.

Turning to FIGS. 9 and 10, an electronic drum 10' embodying the present invention includes a drum body 10A', a vibration sensor 10B' and a damper 10C'. The drum body 10A' and vibration sensor 10B' are similar to the drum body 10A and vibration sensor 10B, and only the damper 10C' is different from the damper 10C. For this reason, component parts of the drum body 10A' and component parts of the vibration sensor 10B' are labeled with the same references designating the corresponding component parts of the first embodiment without detailed description for the sake of simplicity. Although the electronic drum 10' is connected to an electronic sound generator, which in turn is connected to a sound sub-system, the electronic sound generator and sound sub-system are similar to those of the first embodiment, and are not described hereinafter for avoiding the repetition.

The damper 10C' is located on the opposite side to the sensor unit 40, and includes a damping block 31, a supporting plate 32 and an adjuster 33. The damping block 31 and supporting plate 32 have an arched configuration, and the damping block 31 is laminated on the supporting plate 32. The damping block 31 and supporting plate 32 have an arched configuration, and are equivalent to a quarter of the periphery of the drum head 11. The damping block 31 is, by way of example, made of urethane sponge, and the supporting plate 32 is made of metal such as, for example, iron. In this instance, the damping block 31 is adhered to the supporting plate 32. The adjuster 33 is secured at one end thereof to the shell 13 and at the other end thereof to the supporting plate 32, and retains the damping block 31 beneath the drum head 11. The adjuster 33 presses the damping block 31 to or spaces it from the reverse surface of the drum head 11. Thus, the pressure between the damping block 31 and the drum head 11 is regulable by means of the adjuster 33.

Figure 11:
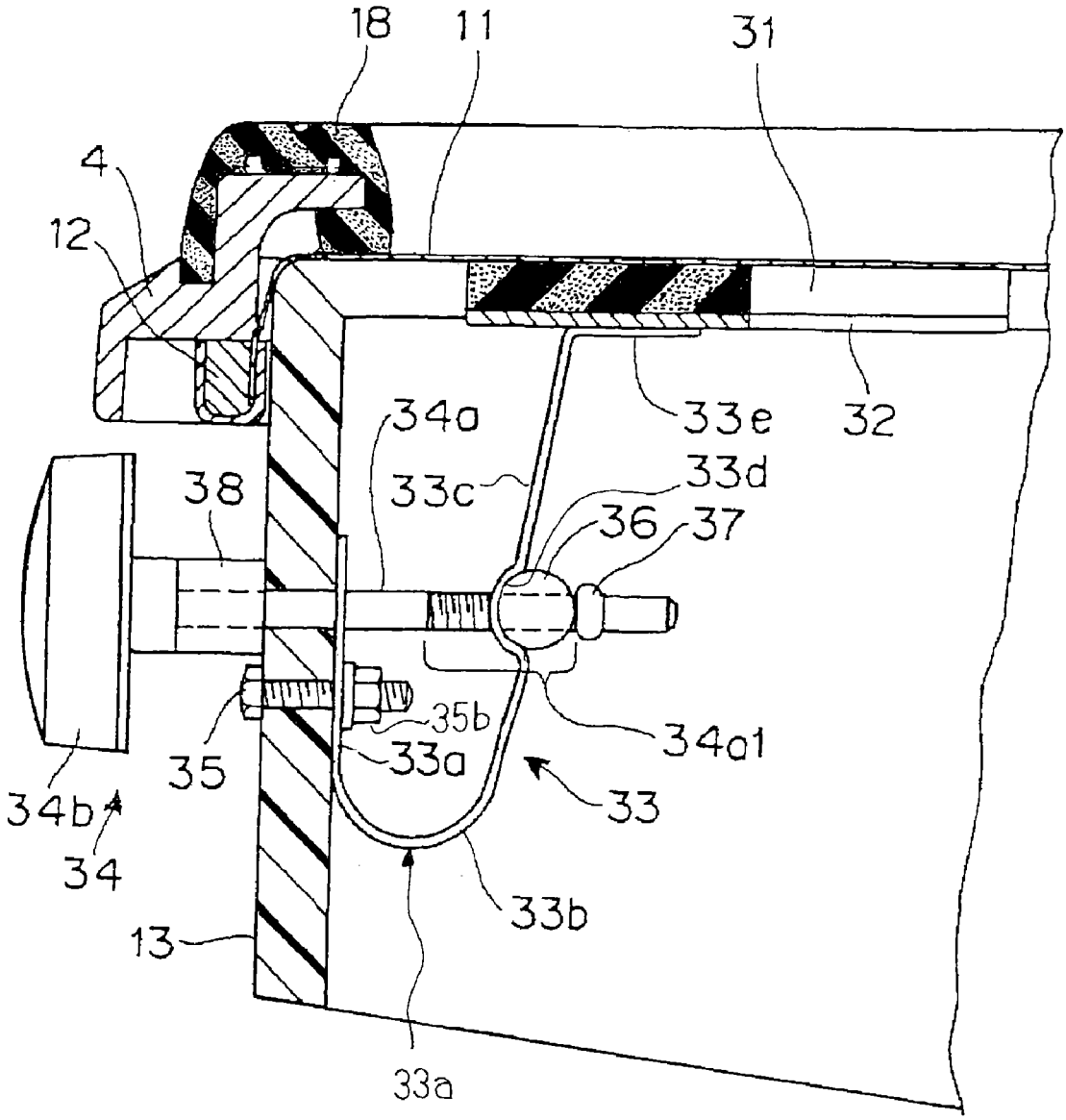
FIG. 11 is a cross sectional view showing a damper incorporated in the electronic drum.

As will be better seen in FIG. 11, the adjuster 33 includes a spring 33*a*, an adjusting bolt 34, bolts 35, a column-shaped nut 36, a stopper 37 and a collar 38. The spring 33*a* has a U-letter shape, and a short portion 33*a* is connected through a curved portion 33*b* to a long portion 33*c*. The long portion 33*c* is partially deformed so that a dent 33*d* and a flat terrace 33*e* take place. An upper through-hole and plural lower through-holes are formed in the short portion 33*a*, and a through-hole is formed in the long portion 33*c*. The through-hole in the long portion is laterally elongated. The bolts 35 pass through through-holes, which are formed in the shell 13, and the lower through-holes, and are screwed into nuts 35*b*, respectively. Thus, the short portion 33*a* is secured to the shell 13 by means of the bolts 35 and nuts 35*b*. When the short portion 33*a* is secured to the shell 13, the long portion 33*c* gets close to the shell 13 and spaced therefrom through the elastic deformation. While the long portion 33*c* is being elastically deformed and returning to the initial shape, the flat terrace 33*e* reciprocally draws an arc about a certain axis in the curved portion 33*a*. The flat terrace 33*e* is secured to the supporting plate 33*e* so that the supporting plate 32 and damping block 31 are moved together with the flat terrace 33*e*.

The column-shaped nut 36 is formed with a female screw. The column-shaped nut 36 is snugly received in the dent 33*d*, and the female screw is aligned with the upper through-hole. The adjusting bolt 34 has a stem 34*a* and a knob 34*b*, and a male screw 34*al* is formed in the stem 34*a*. The stopper 37 is fixed to the stem 34*a*, and is larger in diameter than the female screw formed in the column-shaped nut 36. The stem 34*a* projects into a through-hole formed in the shell 13, and the collar 38 is provided between the knob 34*b* and the shell 13. The stem 34*a* further passes through the upper-through-hole and laterally elongated through-hole, and the male screw 34*al* is engaged with the female screw formed in the column-shaped nut 36. While a drummer is turning the knob 34*b*, the column-shaped nut 36 is moved along the center axis of the stem 34*a*, and exerts a force on and removes the force from the long portion 33*c*. The stopper 37 prohibits the column-shaped nut 36 from moving thereover.

Assuming now that the drummer finds the damping block 31 to be spaced from the reverse surface of the drum head 11, the drummer grasps the knob 34*b*, and gives rise to the right-handed rotation. The stem 34*a* is screwed into the column-shaped nut 36, and, accordingly, the column-shaped nut 36 pushes the long portion 33*c* toward the knob 34*b* against the elastic force of the spring 33*a*. The flat terrace 33*e* and, accordingly, the damping block 31 are leftward moved on the arch. As a result, the damping block 31 is slightly lifted, and is pressed to the reverse surface of the drum head 11.

On the other hand, when the drummer finds the damping block 31 pressed to the reverse surface of the drum head 11 too strongly. The drummer grasps the knob 34*b*, and gives rise to the left-handed rotation. Then, the column-shaped nut 36 is moved toward the stopper 37, and permits the long portion 33*c* to elastically return. Then, the damping block 31 is rightward moved along the arc, and is slightly lowered. Then, the damping head 31 partially removes the pressure from the reverse surface of the drum head 11. Thus, the pressure exerted on the drum head 11 is adjustable by using the adjuster 33.

Upon completion of the adjusting work, the drummer is assumed to start his or her performance on the electronic drum 10'. When the drummer strikes the drum head 11 with a stick, the drum head 11 is shaken, and vibrations follows. The shake is propagated to the sensor cushion 44 without serious decay, because the sensor cushion 44 is held in contact with the area opposite to the area held in contact with the damping block 44. The impact energy is converted to a high peak in the electric signal through the piezoelectric element 43, and is supplied to the electronic sound generator. Even if the drummer softly strikes the drum head 11 with the stick, the impact energy rives rise to a discriminative peak in the electric energy, and the electric beat is surely produced through the sound sub-system. Thus, the drummer produces the electronic beats without any missing shot. Nevertheless, the vibrations are rapidly decayed by virtue of the damping block 31, and any noisy sound does not reach the listener. The second peak is much lower than the first peak so that the electronic sound generator and sound sub-system never generate the electronic beat twice at the single shot.

One of the advantages of the adjuster 3 is the simple adjusting work. Although the drummer has to evenly screw the bolts 21 into the brackets 19, the drummer only rotates the single knob 34*b* for varying the pressure between the drum head 11 and the damping head 31. The adjusting work is simple and easy for the drummer.

Although particular embodiments of the present invention have been shown and described, it will be apparent to those skilled in the art that various changes and modifications may be made without departing from the spirit and scope of the present invention.

The piezoelectric element 43 does not set any limit to the technical scope of the present invention. A photo-coupler or a magnetic sensor/a piece of permanent magnet may be used for converting the shake and vibrations to the electric signal.

The rubber and sponge do not set any limit to the technical scope of the present invention. Any material such as synthetic resin or felt is available for the rim cushion 18 in so far as it suppresses the metallic sound. Similarly, the urethane sponge does not set any limit to the technical scope of the present invention. Any material is available for the damping block 23/31 in so far as it exhibits appropriate damping characteristics.

The drum head 11 may be made from a sheet of skin or a sheet of synthetic resin. The electronic drum may be made in several sizes.

The small triangles 231 do not set any limit to the technical scope of the present invention. The inlets 232 may be defined by semi-circles or semi-ellipses. In those modifications, the peak value is non-linearly varied in the transition areas.

The damper according to the present invention may be incorporated in another sort of percussion instrument such as, for example, an electronic cymbal, an electronic vibraphone or an electronic marimba. Although the electronic cymbal generates electronic beats, the electronic vibraphone and electronic marimba are performed for electronic tones. The term "electronic sounds" represents both of the electronic beats and electronic tones.

The electronic sound generator may have a waveform memory storing plural groups of waveform data for different timbres. In this instance, the drummer selects one of the timbres for his or her performance.

Claims languages are correlated with the component parts of the embodiments. The shell 13 is corresponding to a frame, and the drum head 11 serves as a vibratory layer. The piezoelectric element 43 serves as a vibration-to-electric signal converter. The small triangles 231 are corresponding to plural projections. The adjusting bolt 34, column-shaped nut and stopper 37 as a whole constitute a pusher.

What is claimed is:

1. An electronic percussion system for generating electronic sounds, comprising:

an electronic percussion instrument including a frame, a supporting member supported on said frame and inwardly projecting from said frame, a vibratory layer supported by said frame and having a first surface and a second surface reverse to said first surface, said first surface being adapted to be struck by a player for generating an initial vibration followed by subsequent vibrations, a damper having an outer periphery closer to said frame and an inner periphery closer to a center of said vibratory layer than said outer periphery, said damper being held by said supporting member to be in contact with a part of said vibratory layer for suppressing said vibrations of said vibratory layer, an area of said damper varying repeatedly between a maximum value and a minimum value along the periphery of said part of said vibratory layer, said area of said damper being minimized at first portions of said inner periphery closest to said center of said vibratory layer and maximized at second portions of said inner periphery closest to said outer periphery, and a vibration-to-electric signal converter held in contact with another part of said vibration layer free from said damper and producing an electric signal representative of said initial vibration and said subsequent vibrations;

an electronic sound generator connected to said vibration-to-electric signal converter, and producing an audio signal on the basis of said electric signal; and a sound sub-system connected to said electronic sound generator, and generating said electronic sounds from said audio signal.

2. The electronic percussion system as set forth in claim 1, in which said frame has a cylindrical configuration formed with an opening, and said opening is closed with said vibratory layer.

3. The electronic percussion system as set forth in claim 2, in which said damper is accommodated in an inner space of said frame so that said damper is held in contact with said second surface of said part of said vibratory layer.

4. The electronic percussion system as set forth in claim 2, in which said damper is accommodated in an inner space of said frame so that said damper is held in contact with said second surface of said part of said vibratory layer, and said vibration-to-electric converter is held in contact with said first surface of said another part of said vibratory layer.

5. The electronic percussion system as set forth in claim 2, in which said part of said vibratory layer and said another part of said vibratory layer are a peripheral portion of said vibratory layer and another peripheral portion of said vibratory layer, respectively, and said player mainly strikes a central portion of said vibratory layer.

6. The electronic percussion system as set forth in claim 5, in which said part of said vibratory layer has a first sub-part and a second sub-part closer to said central portion than said first sub-part, said first sub-part is entirely held in contact with said damper, and said second sub-part is partially held in contact with said damper.

7. The electronic percussion system as set forth in claim 6, in which said damper has an outer portion held in contact with said first sub-part of said part of said vibratory layer and an inner portions inwardly projecting from said outer portion at intervals and held in contact with areas of said second surface of said second sub-part of said part of said vibratory layer.

8. The electronic percussion system as set forth in claim 7, in which said plural projections have respective triangle surfaces held in contact with said said areas of said second surface of said second sub-part of said part of said vibratory layer.

9. The electronic percussion system as set forth in claim 1, in which said frame has an external appearance like a drum, and a drum head serve as said vibratory layer.

10. The electronic percussion instrument as set forth in claim 1, in which the damper has a side surface positioned in contact with an inner surface of said frame.

11. An electronic percussion instrument comprising a frame, a supporting member supported on the frame and inwardly projecting from said frame, a vibratory layer supported by the frame and having a first surface struck by a player for generating an initial vibration followed by subsequent vibrations and a second surface reverse to said first surface, a damper having an outer periphery closer to said frame and an inner periphery closer to a center of vibratory layer than said outer periphery, said damper being held by the supporting member to be in contact with a part of said vibratory layer for suppressing said vibrations of said vibratory layer, an area of said damper varying repeatedly between a maximum value and a minimum value along the periphery of said part of said vibratory layer, said area of said damper being minimized at first portions of said inner periphery closest to said center of said vibratory layer and maximized at second portions of said inner periphery gets closest to said outer periphery, and a vibration-to-electric signal converter held in contact with another part of said vibration layer different from said part and producing an electric signal representative of said initial vibration and said subsequent vibrations.

12. The electronic percussion instrument as set forth in claim 11, in which said frame has a cylindrical configuration formed with an opening, and said opening is closed with said vibratory layer.

13. The electronic percussion instrument as set forth in claim 12, in which said damper is accommodated in an inner space of said frame so that said damper is held in contact with said second surface of said part of said vibratory layer, and said vibration-to-electric converter is held in contact with said first surface of said another part of said vibratory layer.

14. The electronic percussion instrument as set forth in claim 12, in which said part of said vibration layer and said another part of said vibration layer are a peripheral portion of said vibratory layer and another peripheral portion of said vibratory layer, respectively, and said player mainly strikes a central portion of said vibratory layer.

15. The electronic percussion instrument as set forth in claim 14, in which said part of said vibratory layer has a first sub-part and a second sub-part closer to said central portion than said first sub-part, said first sub-part is entirely held in contact with said damper, and said second sub-part is partially held in contact with said damper.

16. The electronic percussion instrument as set forth in claim 15, in which said damper has an outer portion held in contact with said first sub-part of said part of said vibratory layer and an inner portions inwardly projecting from said outer portion at intervals and held in contact with areas of said second surface of said second sub-part of said part of said vibratory layer.

17. The electronic percussion instrument as set forth in claim 16, in which said projections have respective triangle surfaces held in contact with said said areas of said second surface of said second sub-part of said part of said vibratory layer.

18. The electronic percussion instrument as set forth in claim 11, in which said frame has an external appearance like a drum, and a drum head serve as said vibratory layer.

19. The electronic percussion instrument as set forth in claim 11, in which the damper has a side surface positioned in contact with an inner surface of said frame.

20. An electronic percussion system for generating electronic sounds, comprising:

an electronic percussion instrument including a frame having a shell and a supporting plate inwardly projecting from said shell, a vibratory layer supported by the frame and having a first surface and a second surface reverse to said first surface, said first surface being adapted to be struck by a player for generating an initial vibration followed by subsequent vibrations, a damper having an outer periphery closer to said frame, an inner periphery closer to a center of vibratory layer than said outer periphery, a major surface held in contact with a part of said vibratory layer, another major surface reverse to said major surface and held in contact with said supporting plate and a side surface held in contact with an inner surface of said shell for suppressing said vibrations of said vibratory layer, an area of said major surface of said damper varying repeatedly between a maximum value and a minimum value along the periphery of said part of said vibratory layer, said area of said damper being minimized at first portions of said inner periphery closest to said center of said vibratory layer and maximized at second portions of said inner periphery closest to said outer periphery, and a vibration-to-electric signal converter held in contact with another part of said vibration layer free from said damper and producing an electric signal representative of said initial vibration and said subsequent vibrations;

an electronic sound generator connected to said vibration-to-electric signal converter, and producing an audio signal on the basis of said electric signal; and a sound sub-system connected to said electronic sound generator, and generating said electronic sounds from said audio signal.

* * * * *

UNITED STATES PATENT AND TRADEMARK OFFICE

CERTIFICATE OF CORRECTION

PATENT NO. : 7,569,758 B2
APPLICATION NO. : 10/609574
DATED : August 4, 2009
INVENTOR(S) : Harada et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1018 days.

Signed and Sealed this

Seventh Day of September, 2010

David J. Kappos

David J. Kappos
*Director of the United States Patent and Trademark Office*